United States Patent [19]

Kogiso et al.

[11] 4,427,418

[45] Jan. 24, 1984

[54] DEVICE FOR COLLECTING PARTICULATES IN EXHAUST GASES

[75] Inventors: Takeshi Kogiso; Hiroshi Ohkawa, both of Aichi, Japan

[73] Assignee: Kabushiki Kaisha Toyota Chuo Kenkyusho, Japan

[21] Appl. No.: 356,289

[22] Filed: Mar. 9, 1982

[30] Foreign Application Priority Data

Mar. 16, 1981 [JP] Japan ..... 56-38442

[51] Int. Cl.[3] ..... B01D 39/20; F01N 3/02; F01N 3/36

[52] U.S. Cl. ..... 55/287; 55/288; 55/301; 55/523; 55/524; 55/DIG. 10; 55/DIG. 30; 60/300; 60/303; 60/311; 422/178; 422/223

[58] Field of Search ..... 55/208, 282, 286–288, 55/301, 466, 523, 524, 526, DIG. 10, DIG. 30; 60/295, 299, 300, 303, 311; 422/174, 178, 180, 223

[56] References Cited

U.S. PATENT DOCUMENTS

| | | | |
|---|---|---|---|
| 3,140,936 | 7/1964 | Schwartz | 55/208 |
| 3,408,794 | 11/1968 | Stoddard | 55/282 |
| 3,734,293 | 5/1973 | Biskis | 55/208 |
| 4,270,936 | 6/1981 | Mann | 55/466 |
| 4,276,066 | 6/1981 | Bly et al. | 55/287 |
| 4,281,512 | 8/1981 | Mills | 60/311 |
| 4,299,600 | 11/1981 | Kobashi | 55/466 |
| 4,329,162 | 5/1982 | Pitcher, Jr. | 210/510 |
| 4,359,864 | 11/1982 | Bailey | 55/DIG. 30 |

FOREIGN PATENT DOCUMENTS

| | | | |
|---|---|---|---|
| 2519609 | 11/1976 | Fed. Rep. of Germany | 60/311 |
| 2051604 | 1/1980 | United Kingdom | 55/208 |

*Primary Examiner*—David L. Lacey
*Attorney, Agent, or Firm*—Berman, Aisenberg & Platt

[57] ABSTRACT

A device for collecting and burning particulates in exhaust gases from an internal combustion engine comprises: a casing having an inlet port and a discharge port for exhaust gases; at least one trapper of porous and heat resistant material disposed within the casing; and a plurality of electric heaters separately disposed a predetermined distance apart from each other on or adjacent to a surface of the trapper which confronts the inlet port and connected to a power source, each of said electric heaters having a predetermined heating area. This device effectively collects and burns particulates in exhaust gases with reduced amount of electric power.

19 Claims, 11 Drawing Figures

DEVICE FOR COLLECTING PARTICULATES IN EXHAUST GASES

BACKGROUND OF THE INVENTION

1. Field of the Invention

The present invention relates to a device for collecting and burning particulates, such as soot particles, contained in exhaust gases from an internal combustion engine, such as a diesel engine or the like.

2. Description of the Prior Art

Known particulate removal devices include a dust collector which is disposed in an exhaust system of a diesel engine and which comprises, as a main element, a trapper made of porous ceramics, such as a ceramic foam or the like, for collecting particulates therein. Such a particulate removal arrangement will develop an increased pressure loss in the exhaust system and reduce the output power of the engine with an increase in the amount of particulates collected in the trapper. It is therefore necessary to regenerate the trapper at certain intervals of time, for example, each time an automotive vehicle carrying such a trapper travels for several hundred kilometers.

It has been known to regenerate a trapper by burning particulates as attached thereto with an auxiliary burner. However, it is not preferable to install such an auxiliary burner in the exhaust system of an internal combustion engine.

Another known arrangement for regenerating a trapper comprises an electric heater to heat an end surface of the trapper through which an exhaust gas is introduced up to a temperature at which particulates are combustible. Thereafter, secondary air is supplied to burn the heated particulates on the trapper. Generated heat upon combustion is utilized to burn particulates progressively through the trapper to the opposite end surface thereof. The trapper with such electric heater will consume an electric power ranging from 2 to 3 KW until the end surface of the trapper is heated to a temperature (a little higher than 600° C.) at which the particulates are combustible. The trapper is therefore practically infeasible due to a limitation imposed on the maximum electric power available for such trapper.

SUMMARY OF THE INVENTION

The present invention has been made in an effort to reduce the power consumption necessary for such particulate ignition heater. Accordingly, an object of the present invention is to provide an improved device for collecting particulates in exhaust gases from an internal combustion engine, which facilitates ignition and burning of such particulates by use of a plurality of electric heaters each having a small heating area, thus providing locally high temperature portions on the surface of a trapper.

Another object of present invention is to provide a device for collecting particulates, in which the power consumption may be further reduced by successively energizing a plurality of electric heaters one by one or one group after another.

A further object of the present invention is to provide a device for collecting particulates, in which collected particulates are effectively burnt to enable repeated use of the device.

These and other objects of the invention are attained by providing a device for collecting particulates in exhaust gases from an internal combustion engine comprising a casing having an inlet port and a discharge port for introducing and discharging exhaust gases, at least one trapper of porous and heat resistant material disposed within the casing between the inlet and discharge ports, and a plurality of electric heaters separately disposed a predetermined distance apart from each other on or adjacent to a surface of the trapper which confronts the inlet port and connected to a power source, each electric heater having a predetermined heating area. A plurality of electric-resistance heaters, each having a heating area of 0.2 to 3 $cm^2$ may be employed.

BRIEF DESCRIPTION OF THE DRAWINGS

FIG. 1 is a longitudinal cross-sectional view of the device; FIG. 2 is an enlarged view of a trapper surface; FIG. 3 is a transverse cross-sectional view of trappers; FIG. 4 is a fragmentary view of a spring;

FIG. 7 is a longitudinal cross-sectional view of the device; FIG. 8 is a transverse cross-sectional view of heaters in the device; FIG. 9 is an enlarged view of heaters as shown in FIG. 8.

DETAILED DESCRIPTION

Figure 1:
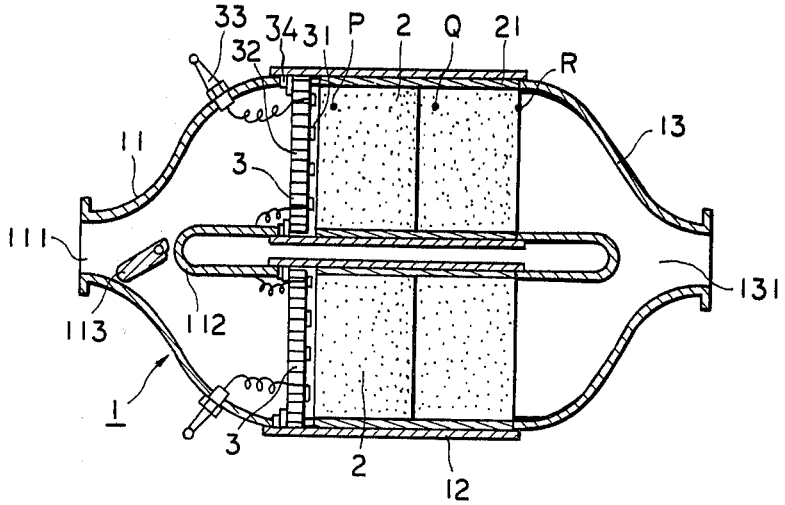
FIGS. 1 through 4 show a device according to a first embodiment of the invention.
Figure 2:
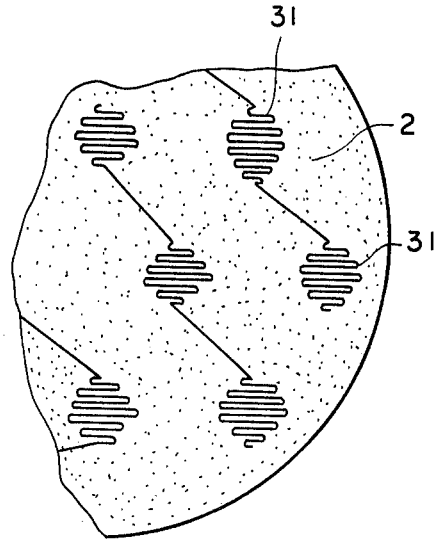

The casing and trapper of the collecting device according to the present invention may be of known construction. The casing may comprise either a single cylindrical body or two cylindrical bodies for housing two independent trappers therein. The casing with the inlet and discharge ports for the exhaust gas is not limited to a particular shape and other particular properties as long as it serves as a holder for the trapper. The casing should preferably be of a simple cylindrical configuration as with the casings of conventional collectors. From the practical standpoint, the casing should be made of steel or the like which is resistant to corrosive attack from the exhaust gas and which can be fabricated and handled with ease. However, the casing is not limited to that material.

The trapper has many complex through holes in which particulates in the exhaust gas impinge on the walls of the holes and are trapped therein while the exhaust gas flows through the holes. The trapper may be in the form of a porous body of ceramics or a ceramic honeycomb having a multiplicity of rectilinear through holes. The trapper may also be formed of ceramic coated metal wires (being tangled), such as of stainless steel. Further, the trapper may be composed of ceramic fibers as bundled, knitted, or woven together, in which interstices between adjacent fibers serve as continuous holes. The trapper may be formed of other materials provided they are heat resistant.

Preferably, the trapper has a porosity of 60 to 85% and has an average pore diameter of 2 to 4 mm so that particulates in exhaust gases can be effectively collected and the pressure loss due to clogged pores is minimized.

A plurality of electric heaters serve as an ignitor for igniting particulates, such as soot particles collected in the trapper. For example, a plurality of electric-resistance heaters, each having a heating area of 0.2 to 3 $cm^2$ may be used.

The heaters are disposed on or adjacent to (e.g. embedded in) the surface of the trapper which confronts the inlet port of the casing through which the exhaust gas is introduced.

The heaters may be fixed directly to the trapper, or may be secured to a holder such that the heaters are held against the trapper. In the latter case, the holder should be loaded by a resilient member, such as a spring, to apply a constant force against the holder and the trapper.

Each heater may comprise a wire of high electric resistance, such as a Nichrome wire, which is two-dimensionally wound spirally or bent into a zigzag configuration with turns or bent lengths being spaced from each other. As an alternative, the heater may be composed of an electrically resistive wire integrally fixed to the trapper surface as by welding.

Each heater should preferably have a heating area of 0.2 to 3 $cm^2$ on a plane extending parallel to the trapper surface facing the inlet port or perpendicularly to the direction of flow of the exhaust gas. Where the area is smaller than 0.2 $cm^2$, ignition may not start. The heating area may be larger; however, when it is more than 3 $cm^2$, the resulting benefits, such as an increase in the effectiveness of stable ignition and an increase in the rate of spreading of combustion in a direction normal to the flow of the exhaust gas, are not sufficiently great to meet the increased consumption of electric power required for such a large heating area. Where the electric power consumption may be increased, the heating area of the heater may be increased. The size of the heater with respect to the direction of flow of the exhaust gas is not limited to a particular value. It is preferable that the heater itself serves as a body for collecting soot particles and the like in the exhaust gas so as to facilitate ignition of the particulates collected thereby.

The heaters should be separately disposed a predetermined distance apart from each other so that electric power may be concentrated on each heater. This makes it possible to provide a plurality of high temperature portions on the surface of the trapper with a small amount of electric power. Accordingly, ignition of particulates at such portions is facilitated.

The rate at which combustion proceeds perpendicularly in the trapper is largely dependent on the speed at which the exhaust gas flows at that time. The inventors have confirmed through experiments that where secondary air flowing at a slow speed of about 0.35 m/sec. is used instead of the exhaust gas, combustion of particulates progresses also in the perpendicular direction. Further, the more the particulates would become attached to the trapper, the greater the rate at which the combustion progresses perpendicularly to the direction of flow of the exhaust gas.

Where the conditions, such as the amount of particulates collected in the trapper, the quantity and temperature of the exhaust gases, and the like, can sufficiently be controlled, the heaters may be spaced from adjacent ones by larger distances. Actually, the heaters should preferably be spaced 0.5 cm to 5 cm from adjacent ones. The heaters may be disposed substantially evenly apart from each other. The heaters are connected through switches to a power source (either direct or alternating current source.)

To lower the maximum electric power consumed, the heaters should preferably be energized successively one by one. However, since it would take a prolonged period of time to energize all of the heaters, the heaters may be energized successively one group after another or all at once.

Figure 3:
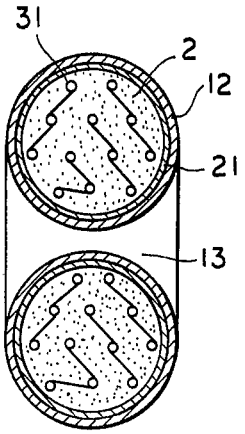
Figure 4:
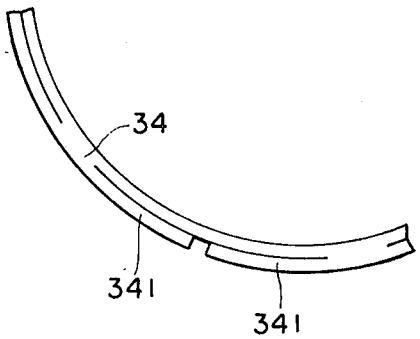

Embodiments of the present invention will now be described. FIGS. 1 through 4 show a device for collecting particulates in exhaust gases from an internal combustion engine according to a first embodiment of the invention. This device is of the two-cylinder type having two separate trappers. The device essentially comprises: a casing 1 composed of two central tubes 12 and covers 11, 13 disposed respectively at ends of the central tubes 12; trappers 2 housed respectively in the central tubes 12; and ignitors 3 disposed at ends of the trappers 2. The casing 1 is made of a steel plate, and each of the covers 11, 13 has a central opening at its distal end (inlet port 111 and outlet port 131) and the covers have juxtaposed openings at the other end. The central opening in the cover 11 serves as an inlet port 111 for introducing an exhaust gas therethrough, and the central opening in the cover 13 serves as an outlet port 131 for discharging the exhaust gas therethrough. The cover 11 has its interior divided by a central partition 112 into two spaces, the central partition 112 having a pivotable valve 113 which is angularly movable up and down to close one of the spaces at a time. An exhaust gas as introduced through the inlet port 111 is guided by the valve 113 to enter either one of the spaces in the cover 11. The trapper 2 (composed of two separate portions arranged in series) is disposed in each of the central tubes 12, each portion being formed of a columnar ceramic foam of cordierite and having a diameter of 94 mm and a height of 70 mm. An inorganic fibrous thermal insulator 21 is interposed between an outer peripheral surface of the trapper 2 and an inner wall surface of the central tube 12. Each of the ignitors 3 comprises heaters 31 each in the form of a bent Nichrome wire (FIG. 2) having a diameter of 0.5 mm, a holder 32 in the form of a disk of a ceramic honeycomb having through holes extending parallel to the axis thereof, and a terminal 33 fixed to a sidewall of the cover 11. Each heater 31 is shaped as a circle having a heating area of about 1 $cm^2$. Three heaters 31 are formed of a single Nichrome wire and thus interconnected as one group. One trapper 2 is provided with four such groups, thus having a total of twelve heaters (FIG. 3). The distance between adjacent heaters is about 1.6 cm. The ends of Nichrome wires extend through the holes in each holder 32 to the opposite side thereof and are connected to the terminal 33 and to the power source (not shown) through a switch. The holders 32 are inserted in the central tubes 12 to keep the heaters 31 held against the trappers 2, with annular springs 34 finally inserted. As shown in FIG. 4, the spring 34 has outer peripheral cantilevered ends 341 which are bent to one side to produce a spring action, so that the ends 341 (when pressed against one end of the cover 11) urge the holder 32 toward the trapper 2 under reactive forces of the ends 341. Thus, the heaters 31 are sandwiched between the trapper 2 and the holder 32.

The collecting device is assembled by fitting and fixing the two central tubes 12 in the openings of the covers 11, 13.

With the device is thus constructed, the heaters 31 are supported on the holders 32 and sandwiched between the trappers 2 and the holders 32 under the forces of the springs 34, so that the heaters 31 are kept in contact with the trappers 2. The springs 34 are positioned adjacent to the inner wall surfaces of the central tubes 12 and hence are less subjected to contact with a high-temperature exhaust gas.

Figure 5:
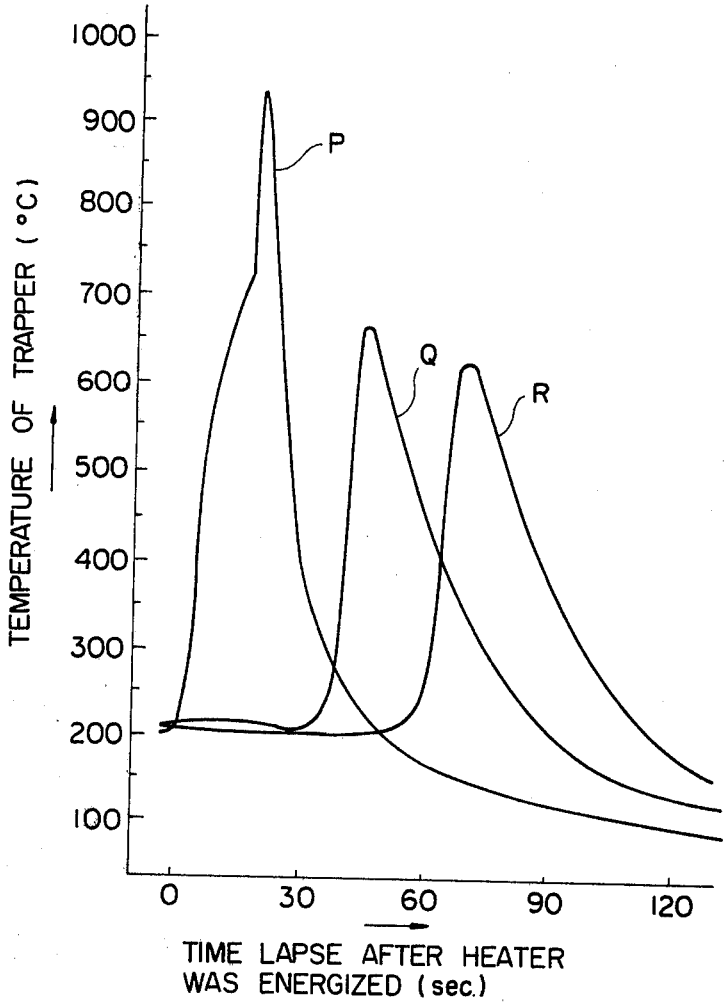
FIG. 5 is a graph showing temperatures at points P, Q, R shown in FIG. 1 which are plotted against time that has elapsed after heaters were energized.

An experiment was conducted in which the collecting device was installed on a diesel engine having a displacement of 2,200 c.c. to remove particulates from an exhaust gas emitted by the diesel engine. The valve 113 was positioned as shown in FIG. 1, and the engine was operated at a rate of 2,000 RPM. The trappers 2 produced a pressure loss of about 40 mmHg immediately after the engine started its operation. The engine was continuously operated for 15 hours. The pressure loss was increased up to approximately 110 mmHg. The engine was then put into an idling mode of operation (at about 800 RPM) with the valve 113 turned to cause most of the exhaust gas to flow through the other trapper 2. The ratio between amounts of exhaust gases flowing through the trappers 2 was about 4 to 1. A calculation indicated that the speed of air capable of flowing through the trapper 2 through which the exhaust gas was forced to flow was about 0.15 m/sec. Then, a voltage of 14 V was applied by a generator to the twelve heaters 31 on this trapper 2 for twenty seconds, and thereafter the heaters 31 were de-energized. Temperatures of the trapper 2 were monitored through thermocouples disposed at points P, Q, R shown in FIG. 1, the results being illustrated in FIG. 5. Combustion through the trapper 2 was completed in about 75 seconds. The electric power of 300 watts was consumed by the total of twelve energized heaters 31.

The above procedure was repeated again with the valve 113 shifted to the position opposite to that shown in FIG. 1. Then, the valve 113 was moved back to the position shown in FIG. 1 and the engine was operated at 2,000 RPM. The pressure loss was reduced down to about 50 mmHg. Operation of the engine and regeneration of the trapper 2 were repeated, and the pressure loss after the trapper 2 was regenerated was substantially constant at about 50 mmHg.

Figure 6:
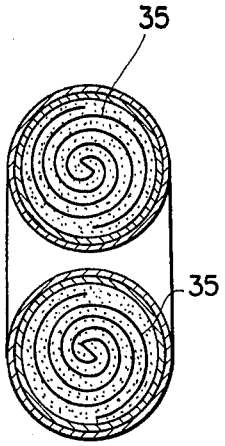
FIG. 6 PRIOR ART
FIG. 6 is a transverse cross-sectional view of heaters in a conventional device.

For comparison, a conventional collecting device (which is of substantially the same structure as that of the collecting device of the present invention except that spiral heaters 35 having a wire diameter of 1 mm were utilized—as shown in FIG. 6) was constructed.

The device of FIG. 6 was installed on a diesel engine having a displacement of 2,200 c.c., and the same test was carried out. With this conventional device, it was not possible to ignite particulates on the trapper. The heater 35 was energized at a voltage of 14 V for 20 seconds. The heater 35 consumed an electric power of about 320 watts. Then, an increased voltage of 21 V was applied by another power supply to the heater, whereupon particulates attached to the trapper were burned in the same combustion progressing pattern as that of the device according to the first embodiment. The heater 35 consumed as much as about 740 watts at this time, and the pressure loss after the trapper was regenerated was about 45 mmHg.

Figure 8:
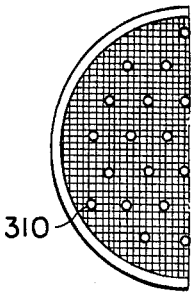
FIGS. 7 through 9 show a device according to a second embodiment of the invention.
Figure 7:
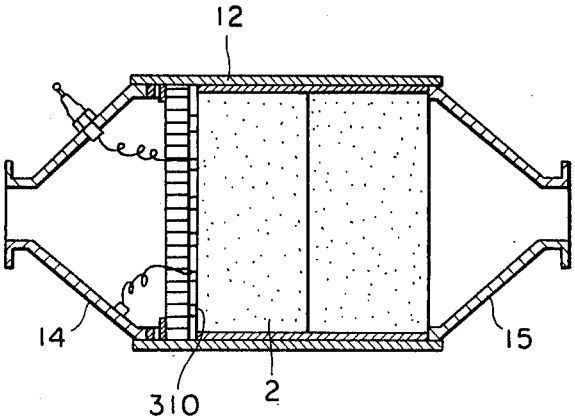
Figure 9:
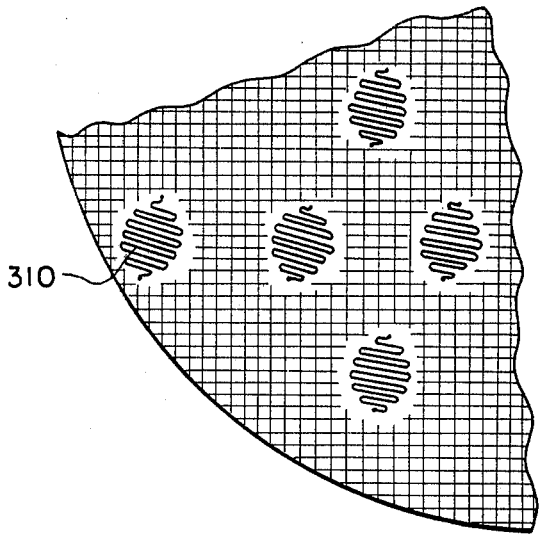

A device according to a second embodiment of the invention is illustrated in FIGS. 7 through 9. The device comprises a single central tube 12 with no valve disposed, funnel-shaped covers 14, 15, and thirty heaters 310.

As illustrated in FIGS. 8 and 9, each of the heaters 310 comprises a wire having a diameter of 0.3 mm and is connected to lead wires which are composed of nickel wires having a diameter of 0.5 mm, the heater having a diameter of 12 mm. The space between heaters is about 1.6 cm. The heaters 310 are energizable and de-energizable independently of each other. One heater 310 consumes about 30 watts when a voltage of 14 V is applied thereto.

The device shown in FIG. 7 was connected to an exhaust pipe of a diesel engine having a displacement of 2,200 c.c., and the engine was operated at 2,000 RPM with a torque of 6 Kg.m continuously of 17 hours. The pressure loss due to the trapper was increased from about 30 mmHg to 100 mmHg. Then, the engine was operated in an idling mode at about 800 RPM, and an air intake port was constricted to allow air to flow at a rate of about 300 l/min. (a reduction to about $\frac{1}{3}$ of the former rate), and all of the thirty heaters 310 were simultaneously fed with an electric current. The heaters 310 were energized for 25 seconds as the voltage thereacross dropped to about 11 V. Attached particulates were burned, and temperature monitoring indicated that the trapper could be regenerated in approximately 90 seconds. The heaters 310 consumed about 850 watts at this time. The trapper (after it was regenerated) caused a pressure loss which is slightly smaller than 40 mmHg.

Then, the heaters 310 in the device according to the second embodiment were successively energized one by one at intervals of five seconds. Each heater 310 was energized for 20 seconds. With these heaters, it was possible to ignite particulates on the trapper so that the trapper could be regenerated.

Figure 10:
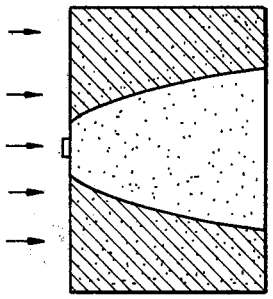
FIGS. 10 and 11 are views showing different modes of trapper combustion development due to varying speeds of flow of air through the trapper.
Figure 11:
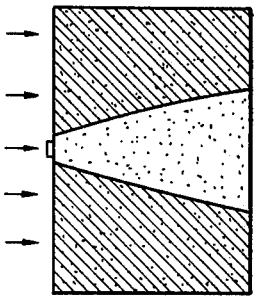

FIGS. 10 and 11 illustrate how the combustion of particulates on the trapper proceeds from each heater 310 while air is forced to flow through the trapper at speeds of 0.35 m/sec. (FIG. 10) and 0.7 m/sec. (FIG. 11). Hatched areas in FIGS. 10 and 11 show portions of the trapper where particulates remain unburned. From this, it is apparent that the combustion of particulates occurs when air flow speed in the perpendicular direction is low.

A total of 60 heaters each having a diameter of 8 mm were also incorporated in the device as shown in FIG. 7, and a similar regeneration experiment was conducted on such a device. As compared with the device employing 30 heaters, no appreciable difference was found since the heaters consumed substantially the same amount of electric power, and restoration to the starting pressure loss was slightly better than the device of FIG. 7.

Although specific embodiments of the invention have been illustrated and described, it will be understood that various alternations may be made therein without departing from the scope of the invention as defined by the appended claims.

What is claimed is:

1. A device for collecting particulates in exhaust gases from an internal combustion engine comprising:

a casing having an inlet port and a discharge port for introducing and discharging said exhaust gases;

at least one trapper of porous and heat resistant material disposed within said casing between said inlet and discharge ports, for collecting particulates in said exhaust gases; and a plurality of electric resistance heaters to facilitate ignition and burning of particulates collected in said at least one trapper, the heaters being separately disposed a predetermined distance apart from each other substantially in contact with a surface of said at least one trapper which confronts said inlet port and connected to a power source such that they are successively energized one by one, each of said plurality of electric resistance heaters having a predetermined heating area on said surface of said at least one trapper.

2. A device according to claim 1, wherein each of said electric resistance heaters has a heating area of 0.2 to 3 $cm^2$.

3. A device according to claim 2, wherein said plurality of electric resistance heaters are disposed substantially evenly spaced apart from each other on said surface of said at least one trapper.

4. A device according to claim 3, wherein said at least one trapper is formed of a porous body of ceramics having through-holes.

5. A device according to claim 4 wherein said plurality of electric-resistance heaters are fixed to a holding member which is resiliently pressed against said at least one trapper.

6. A device according to claim 3, wherein said at least one trapper is formed of a porous body of ceramics having through-holes and said plurality of electric-resistance heaters are grouped, each group comprising at least two electric-resistance heaters, and are connected to said power source such that they are successively energized one group after another.

7. A device according to claim 6, wherein all of said electric-resistance heaters are fixed to a holding member which is resiliently pressed against said at least one trapper.

8. A device according to claim 2, wherein said plurality of electric-resistance heaters are disposed a distance of 0.5 to 5 cm apart from each other.

9. A device according to claim 2, wherein said plurality of electric-resistance heaters are grouped, each group comprising at least two electric-resistance heaters, and are connected to said power source such that they are successively energized one group after another.

10. A device according to claim 2, wherein said plurality of electric-resistance heaters are fixed to a holding member, said holding member being resiliently pressed against said at least one trapper.

11. A device according to claim 2, wherein said plurality of electric-resistance heaters are fixed to said at least one trapper.

12. A device according to claim 2, wherein said at least one trapper has a porosity of 60 to 85%.

13. A device according to claim 2, wherein said at least one trapper is formed of a porous body of ceramics.

14. A device according to claim 2, wherein said at least one trapper is formed of tangled ceramic coated metal wires.

15. A device according to claim 2, wherein said at least one trapper is formed of ceramic fibers.

16. A device according to claim 2, wherein said casing comprises a single cylindrical body.

17. A device according to claim 2, wherein said casing comprises a double cylindrical body having two divided spaces therein and a change-over valve for introducing exhaust gases into one or said two divided spaces and preventing exhaust gases from flowing into the other of said two divided spaces.

18. A device according to claim 1, wherein at least one of the electric heaters is disposed on said surface.

19. A device according to claim 1, wherein at least one of the electric heaters is disposed adjacent to said surface.

* * * * *